US006478607B2

(12) United States Patent
Tabata

(10) Patent No.: US 6,478,607 B2
(45) Date of Patent: Nov. 12, 2002

(54) CONNECTOR

(75) Inventor: Masaaki Tabata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/933,931

(22) Filed: Aug. 21, 2001

(65) Prior Publication Data

US 2002/0025713 A1 Feb. 28, 2002

(30) Foreign Application Priority Data

Aug. 28, 2000 (JP) ..... 2000-257808

(51) Int. Cl.[7] ..... H01R 13/58; H01R 13/40
(52) U.S. Cl. ..... 439/456; 439/459; 439/596
(58) Field of Search ..... 439/367, 136, 439/145, 456, 459, 596

(56) References Cited

U.S. PATENT DOCUMENTS 5,830,006 A * 11/1998 Koumatsu et al. ..... 439/449
5,897,392 A * 4/1999 Takahashi et al. ..... 429/470
2002/0009924 A1 * 1/2002 Little et al. ..... 439/625

FOREIGN PATENT DOCUMENTS

JP 9-293556 11/1997

* cited by examiner

*Primary Examiner*—Khiem Nguyen
*Assistant Examiner*—Chandrika Prasad
(74) *Attorney, Agent, or Firm*—Anthony J. Casella; Gerald E. Hespos

(57) ABSTRACT

A wire cable (15) is led through a housing (10) and is fastened to a position that faces the back end face (10B) of housing (10) by a wire cable cover (20). A lock releasing operation area (16B) of lock arm (16) also is faced on the back end face (10B) of this housing (10). A fastening position of wire cable (15) by the wire cable cover (20) on the back end face (10B) of the housing (10) is disposed at a position offset to a side to the central position in a widthwise direction facing the lock releasing operation area (16B). Therefore, in the lock arm (16) can be operated in the lock releasing operation area (16B), without being interrupted by the wire cable (15), and the lock releasing operation can be carried out without causing any convenience.

17 Claims, 11 Drawing Sheets

CONNECTOR

BACKGROUND OF THE INVENTION

1. Field of the Invention

The invention relates to a connector with a wire cable cover.

2. Description of the Related Art

A known connector is disclosed in Japanese Unexamined Patent Publication No. (Hei) 9-293556 and includes a housing with a wire cable cover. The connector also includes a metal terminal, and a wire cable is fixed onto the back end of the metal terminal. The metal terminal is inserted into the housing, and the wire cable is led towards the outside from the back end face of housing. The wire cable is fastened inside the wire cable cover in a bent condition, and is led in a predetermined direction outside the wire cable cover.

The above-described connector enables the wire cable to be fastened along the back end face of connector. However, the back end face of the housing, also is an area where a lock releasing operation of a lock arm is performed for locking the connector with another connector. Therefore, a wire cable that is positioned and fastened along the back end face of housing may come to a position that overlaps the lock releasing operation area. Thus, the cable can interfere with lock releasing operation.

The present invention was created in reference to the aforementioned circumstances, and is intended for positioning and fastening the wire cable by means of a wire cable cover without causing any inconvenience in the lock releasing operation of lock arm.

SUMMARY OF THE INVENTION

The invention is directed to a connector that comprises a housing into which a metal terminal is inserted. A wire cable is connected with the metal terminal and is led to a location outside the housing. A wire cable cover is mountable onto the housing and fastens portions of the wire cable that are led from the housing. A lock arm is formed in the housing, and has a lock that faces the outer surface of the housing. The lock allows the housing to be locked with a mating housing. The lock arm also has a lock releasing area that can be actuated for releasing the lock from the mating housing. The wire cable is fastened by the wire cable cover. An electrical wire cable supporting area is provided in the wire cable cover and supports the wire cable on the outside area in an offset manner relative to a position that faces the lock releasing area.

The connector also may comprise a cover body in which the wire cable cover interfits with the housing, and a wire cable pressing member that allows a lead through area of the wire cable to be supported and mountable on the cover body in a condition that enables the lead through area of the wire cable to be fastened.

A positioning area is formed in the cover body and allows a lead through area of the wire cable to be positioned with the wire cable pressing member taken off from the cover body.

The wire cable pressing member and the cover body may be integrally connected through a hinge. The hinge allows the wire cable pressing member to cause a relative displacement along a certain locus, such that the area through which the wire cable is threaded is fastened to the cover body.

The wire cable supporting area is disposed in a position shifted to the one end side of a width direction in the wire cable pressing member. Additionally, an engaging area is provided in the cover body for engaging the wire cable pressing member in the cover body. The engaging are is formed in the wire cable pressing area at a position shifted to an opposite side of the wire cable supporting area. The fastening position of wire cable by the wire cable cover is offset against the position provided with lock releasing area on the outside face of housing. Thus, the lock releasing operation can be performed without causing any inconvenience due to absence of the wire cable when operating the lock releasing operation area.

The wire cable cover for the housing is mounted by first mounting the cover body onto the housing. The lead through area of wire cable then is fastened by mounting the wire cable pressing member onto the cover body. The mounting of the wire cable cover onto the housing and the fastening of the wire cable may be separate processes. As a result, the respective processes can be carried out by simple work, thereby ensuring better workability.

The preliminary supporting of the cover body by the positioning area in relation to the wire cable lead through area facilitates simple and positive mounting of wire cable pressing member.

The lead through area of wire cable is fastened by displacing the wire cable along predetermined rows of the cover body. Therefore, the mounting position of the wire cable pressing member for the cover body does not get out of draw, thereby positively offsetting the fastening position of lead through area of wire cable for the lock releasing operation area.

The engaging area for engaging the wire cable pressing member with the cover body is displaced to a reverse side from the wire cable supporting area, namely, a position of dead space caused by a displaced disposition of the wire cable pressing supporting area. Hence, waste in space does not exist for the wire cable pressing member.

DETAILED DESCRIPTION OF THE PREFERRED EMBODIMENT

Figure 4:
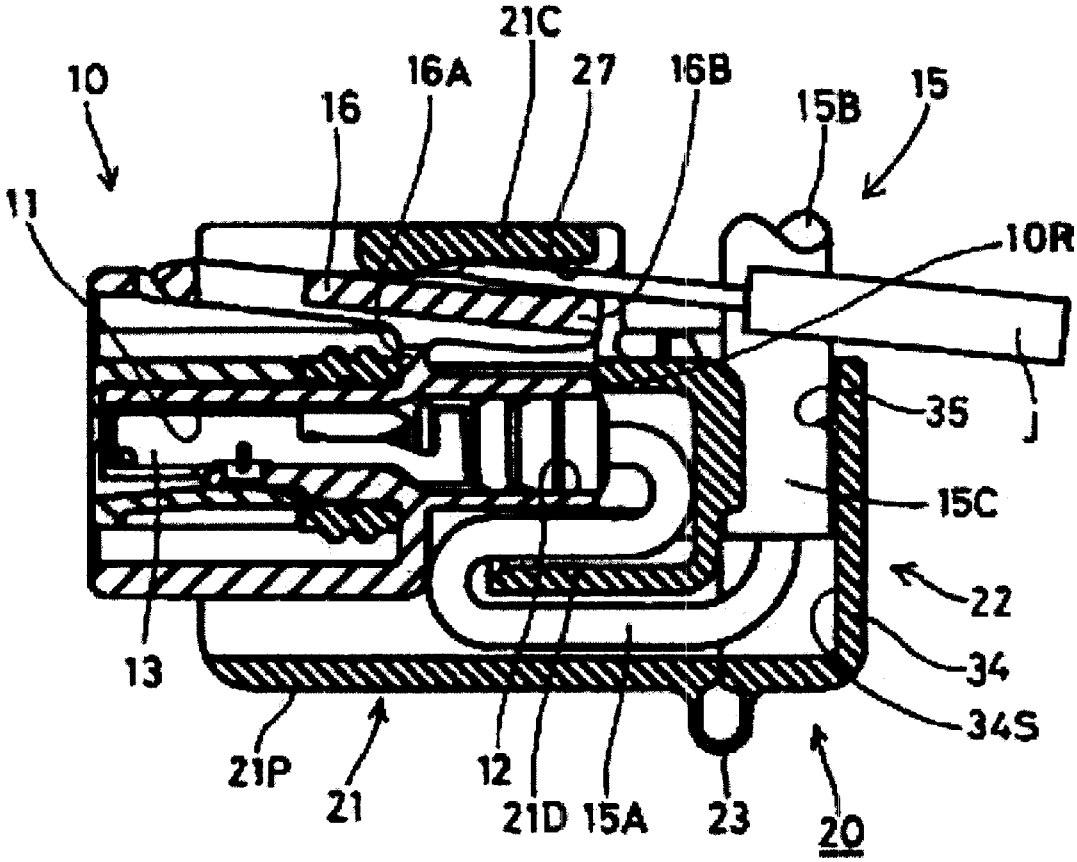
FIG. 4 is a longitudinal cross-sectional view of the connector.

The connector of the present invention has a housing 10 and wire cable cover 20, as shown in FIGS. 1–10. In the description below, the left side in FIG. 4 is referred to as the front and the right side in FIG. 4 is referred to as the rear. In addition, the up and down directions are based on the orientation shown in FIG. 1 to FIG. 7 as standard, and the left and right sides are denoted by the suffixes L and R respectively in the figures.

The housing 10 has left and right cavities 11, and a metal terminal 13 is inserted into each cavity 11 from a terminal inlet 12 which opens to the back end face 10B of the housing 10. A wire cable 15 is connected with the back end area of each terminal 13. The wire cable 15 is an integrated wire cable that has two thin wires 15A covered by a round insulating sheath 15B. The insulation sheath 15B of the cable 15 is stripped off for a predetermined length to expose the two thin wires 15A. The terminals 13 are connected with the respective exposed thin wires 15A by crimping. The two thin wires 15A are led from the terminal insertion inlet through to the back of housing 10 over a predetermined length in an exposed condition. The forward area in a lead through direction further from the exposed thin wire 15A defines a fastened area 15C that is covered with the insulating sheath 15B. The wire cable cover 20 fastens the fastened area 15C, as described later. In addition, both left and right sides of housing 10 have an engaging protrusion 14 for supporting the mounted condition of wire cable cover 20.

A lock arm 16 is formed on the upper face of the housing 10 to lock the housing 10 in an interfitting condition with the mating housing (not shown). The lock arm 16 is long in a back and forth direction, and has a supporting area 16A at the central position in a lengthwise direction. Thus, the locking arm is elastically displaceable in a seesaw manner.

A lock releasing area 16B is formed at the back end face of the lock arm 16 and in a position facing the back end 10B of housing 10.

The lock releasing area 16B can be displaced with a jig J in a direction approaching the upper face of housing 10 to release the lock arm 16. The lock arm 16 prevents any gouging against the mating housing, and is at a central position of a width direction (right and left direction) of housing 10 to keep a balance of lock engaging forces. Therefore, the lock releasing area 16B is also at the central position in a width direction.

The wire cable cover 20 is an integrated part combining a cover body 21 and wire cable pressing member 22 that are connected via a hinge.

The cover body 21 is a cylinder that has a bottom and a front face that is opened entirely. The cover body 21 is mountable on the housing 10 from the back. An abutting area 24 is formed on both right and left walls 21L and 21R of the cover body 21 and is abutted on a stopper 17 of housing 10 to limit forward movement of the cover body 21 on the housing 10. Removal of the cover body 21 is regulated with engaging holes 25 of both right and left walls 21L and 21R of the cover body 21 that are engaged with engaging protrusions 14 on housing 10. Floating movement of the cover body 21 in an up and down direction is regulated with grooves 26 on both right and left walls 21L and 21R on cover body 21 that are interfitted with a guide rib 18 of housing 10. Floating movement in a right and left direction on cover body 21 is regulated with the first half area of both right and left walls 21L and 21R on the cover body 21 interfitted from the top with both right and left faces of housing 10. Thus, the cover body 21 is fixed on the housing 10.

In an assembling condition, an upper wall 21C of cover body 21 overlaps from the top (outer peripheral side) only with a slight jig-insertion space 27 for the second half area of lock arm 16. The lock is released by inserting a thin jig J from the back of housing 10 into the jig-insertion space 27 and pressing down on the lock releasing area 16B.

A lower wall 21D of cover body 21 is cut open from the front end towards the central area. Thus, the lower wall 21D is engaged only with the back end area on the lower face of housing 10 in the assembled condition. The lower side of lower wall 21D of the cover body 21 has a preventive wall 21P that is cantilevered from the lower edge to the left on the right wall 21R of cover body 21. The preventing wall 21D covers the lower wall 21D of cover body 21 and extends further forward from the lower wall 21D. An insertion groove 29 is formed between the left edge of the preventive wall 21P and a preventive rib 28 that protrudes from the lower edge of left wall 21L of cover body 21. The insertion groove 29 is formed over the front end of the preventive wall 21P to the back end, and has a minimum clearance that allows the thin wire cable 15A to pass through without providing a larger clearance. A non-pulling rib 30 is formed on the left edge of the preventive wall 21P and protrudes towards the lower wall 21D.

The lower wall 21D, preventive wall 21P, and insertion groove 29 are provided to bend the thin wire cable 15A in a zigzag manner through the lead area from the housing 10, as explained further below.

Figure 8:
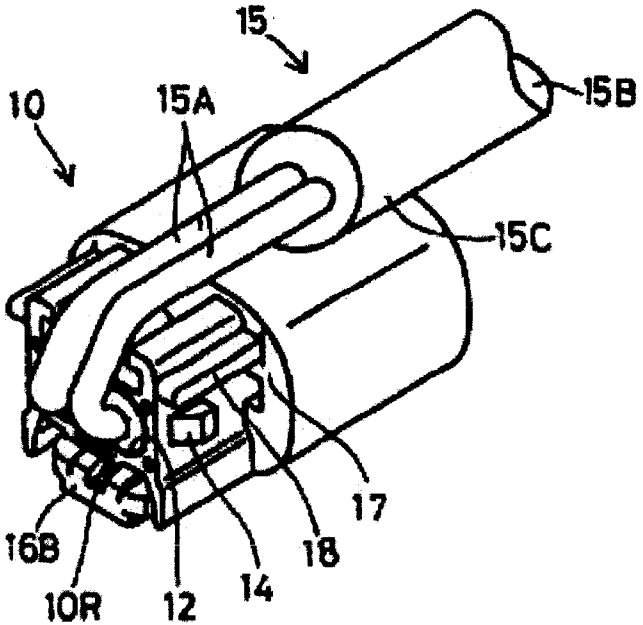
FIG. 8 an exploded perspective view showing the housing and the wire cable cover separated each other.
Figure 8:
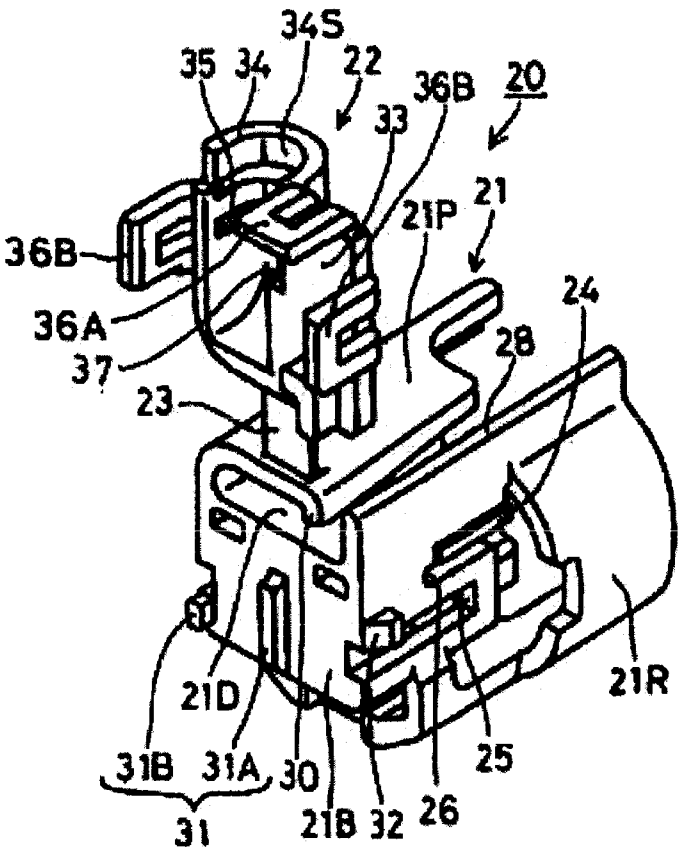

A positioning area 31 protrudes from the outer face of the back wall 21B of the cover body 21, as shown most clearly in FIG. 8. The positioning area 31 is composed of a long rib 31A that extends vertically at a central position in a widthwise direction on the back wall 21B, and a short rib 31B positioned at the upper right end edge on the back wall 21B.

The fastened area 15C of the wire cable 15 is held between the ribs 31A and 31B, and hence is positioned in a condition in which floating movement is regulated in a widthwise direction (right and left direction). More particularly, the fastened area is held at a position deviated from the center of widthwise direction to the right. Furthermore, engaging protrusions 32 are formed on both the right and left walls 21L and 21R and the upper wall 21C of cover 21 to support the wire cable pressing member 22 on cover body 21 in an assembled condition.

The wire cable pressing member 22 is connected with a preventive wall 21P of cover body 21 through a thin square plate shape hinge 23. The hinge 23 extends from the center in a widthwise direction of the lower outer face of the back end area of preventive wall 21P. Before mounting the wire cable pressing member 22 onto the cover body 21, the hinge is parallel with the back wall 21B of cover body 21, and the wire cable pressing member 22 is connected with the extension end edge of the hinge 23. The left half area of the wire cable pressing member 22 is a flat plate 33, while the right half area defines a wire cable supporting area 34. More particularly, the wire cable holding area 34 has an accommodating space 34S opened to a lower direction immediately after molding. A step 35 is provided on the inner periphery of the accommodating space 34S, and extends in a peripheral direction that allows biting into the outer periphery of wire cable 15. Engaging areas 36A, 36B and 36B extend respectively from the lower edge of flat plate area 33, the left edge of flat plate area 33, and right edge of wire cable supporting area 34. In addition, a by-pass area 37 is formed on the wire cable supporting area 34 for avoiding interference with the long rib 31A when assembling onto the cover body 21.

The wire cable pressing member 22 is assembled onto the cover body 21 by deforming the hinge 23 in a turn-up manner, reversing the hinge 23 as a near-fulcrum, and then engaging the engaging areas 36A and 36B with respective engaging protrusions 32, to lock the wire cable pressing member 22 in the assembling condition. In the assembled condition, the flat plate area 33 is in close contact with the back wall 21B of the cover body 21. In the same assembling condition, an opening area is formed forward of wire cable supporting area 34. Also, with the same assembling condition, nearly all of the opening area forward of the wire cable supporting area 34 is closed with the back wall 21B except for the lower end area. This leads to a condition where the lower end area is interconnected with the opening on the back side between the lower wall 21D of cover body 21 and the preventive wall 21P, and only the upward opening of wire cable supporting area 34 faces outwards.

A fastened area 15C of the wire cable 15 is accommodated at the accommodating space 34S between the cover body 21 and wire cable supporting area 34.

The upper edge of wire cable pressing member 22 is lower than the lock releasing operation area 16B of lock arm 16, when the wire cable pressing member 22 is assembled on the cover body 21. Therefore, the wire cable pressing member 22 does not impede the lock releasing operation that is generated by inserting a jig J into a jig insertion area 27.

Assembly commences with the wire cable cover 20 and the housing 10 detached. A metal terminal 13 connected with a thin wire cable 15A then is inserted in a cavity 11 in the housing 10, as shown in FIG. 8. The wire cable 15 then is led through the housing 10 from the back end face 10B and is turned down, as shown in FIG. 4.

Figure 5:
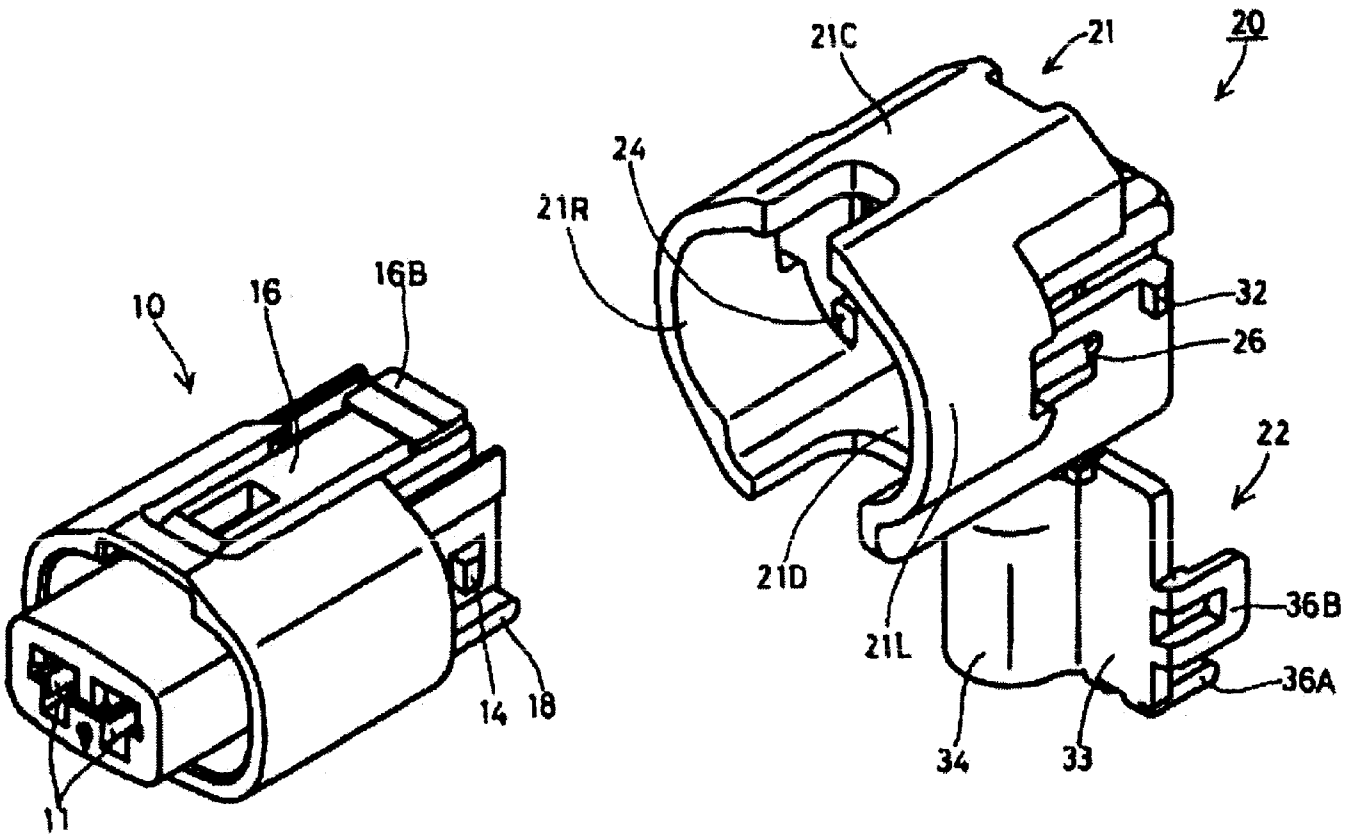
FIG. 5 is an exploded perspective view showing the housing and the wire cable cover area separated each other.
Figure 6:
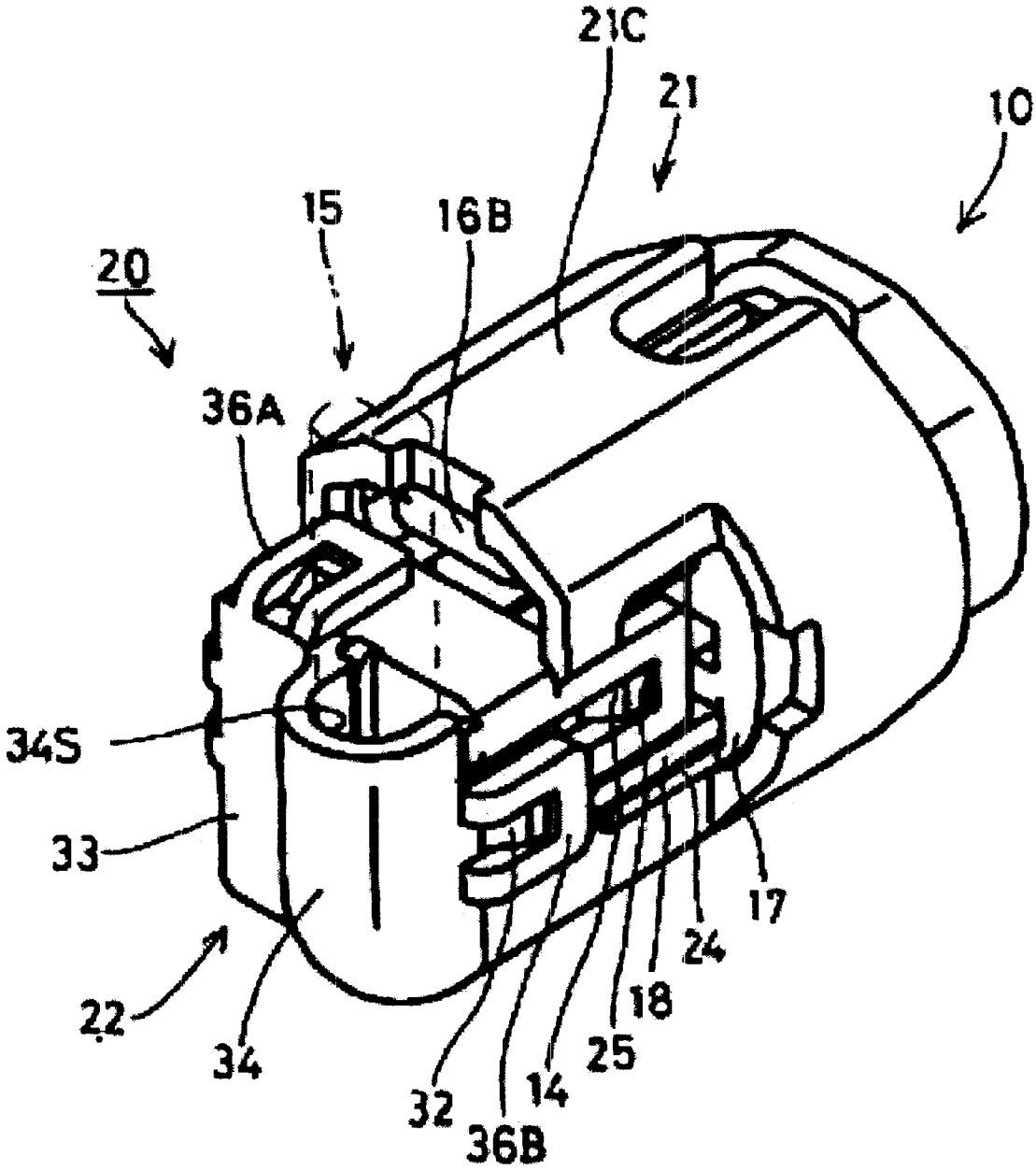
FIG. 6 is a perspective view from the rear showing the connector in an assembled condition.
Figure 7:
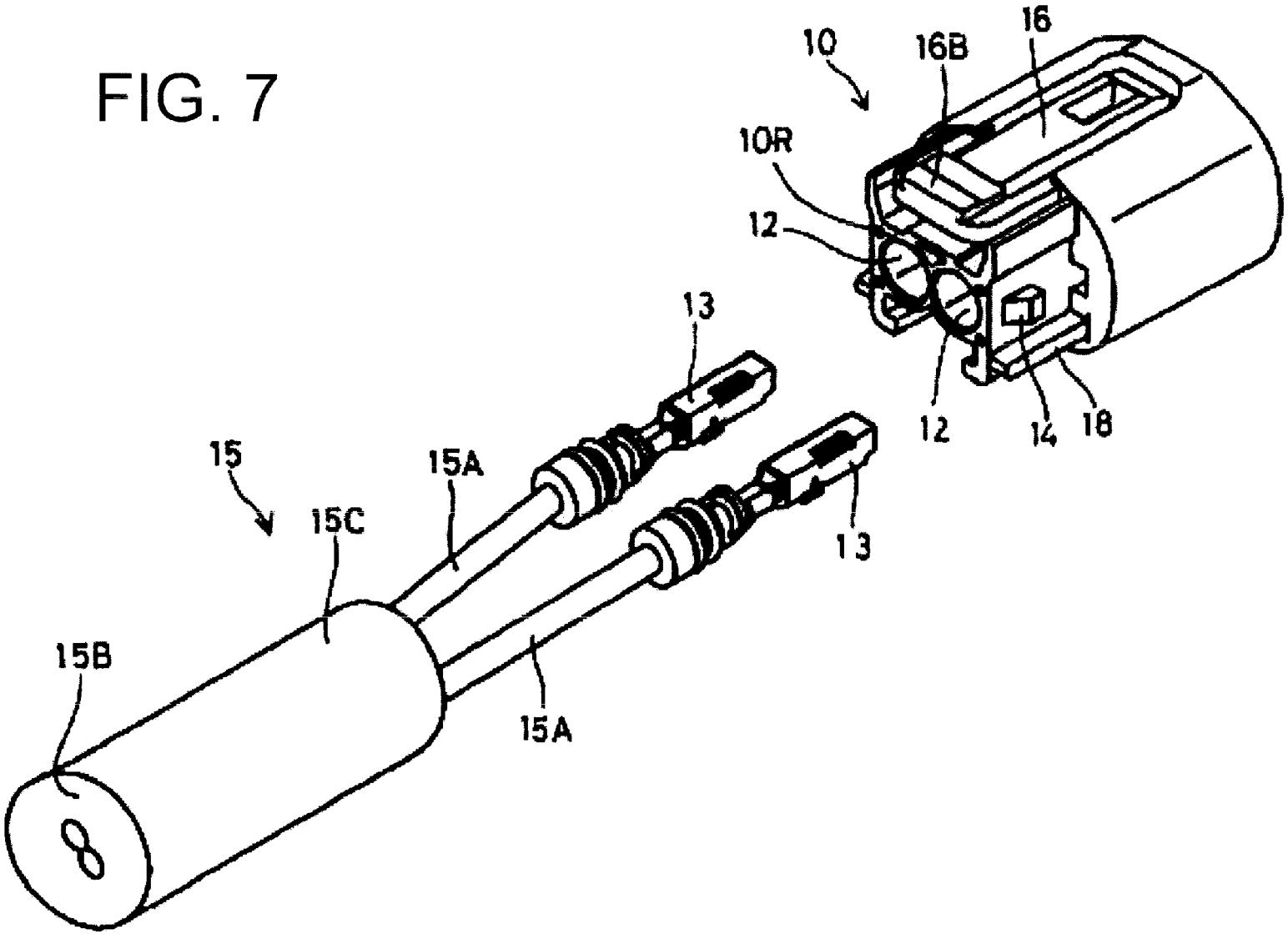
FIG. 7 is an exploded perspective view showing a condition in which a housing, a wire cable, and a terminal are separated each other.

The cover body 21 of wire cable cover 20 then is assembled onto the housing 10 from the top and the back of the housing 10. At this time, the wire cable pressing member 22 is not assembled onto the cover body 21, and, as shown in FIGS. 5 and 9, the wire cable pressing member 22 protrudes from the cover body 21.

Figure 9:
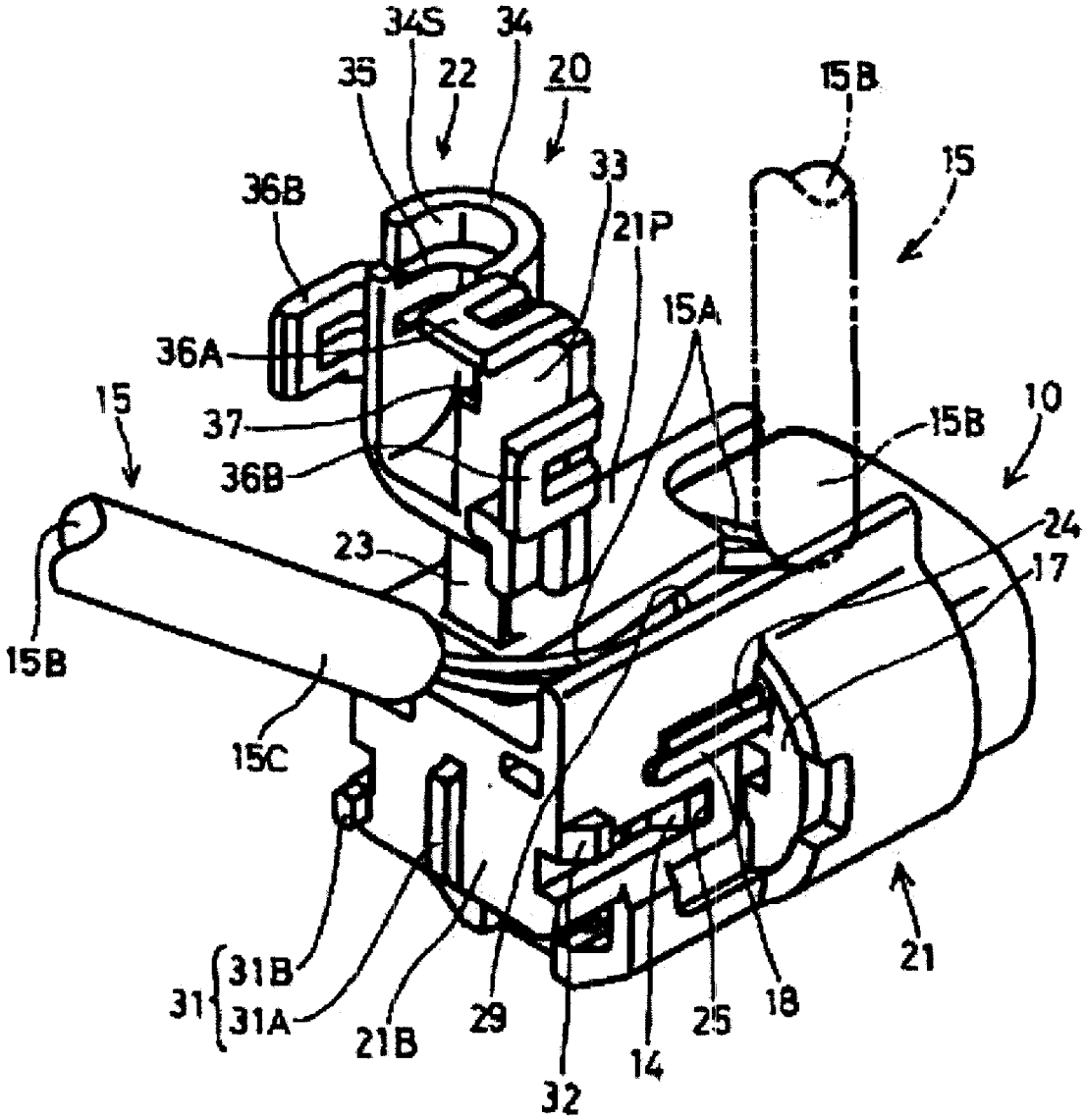
FIG. 9 is a perspective view showing the wire cable cover assembled onto the housing.

The thin wire cable 15A (as shown with a chain line in FIG. 9) of the wire cable 15 that was turned toward the front next is turned back through the insertion groove 29 of the cover body 21, and is inserted into a space between a lower wall 21D and a preventive wall 21P, as shown with a solid line in FIG. 9. The thin wire cable 15A then is led through towards the back from the opening of the back end between both walls 21D and 21P.

Figure 10:
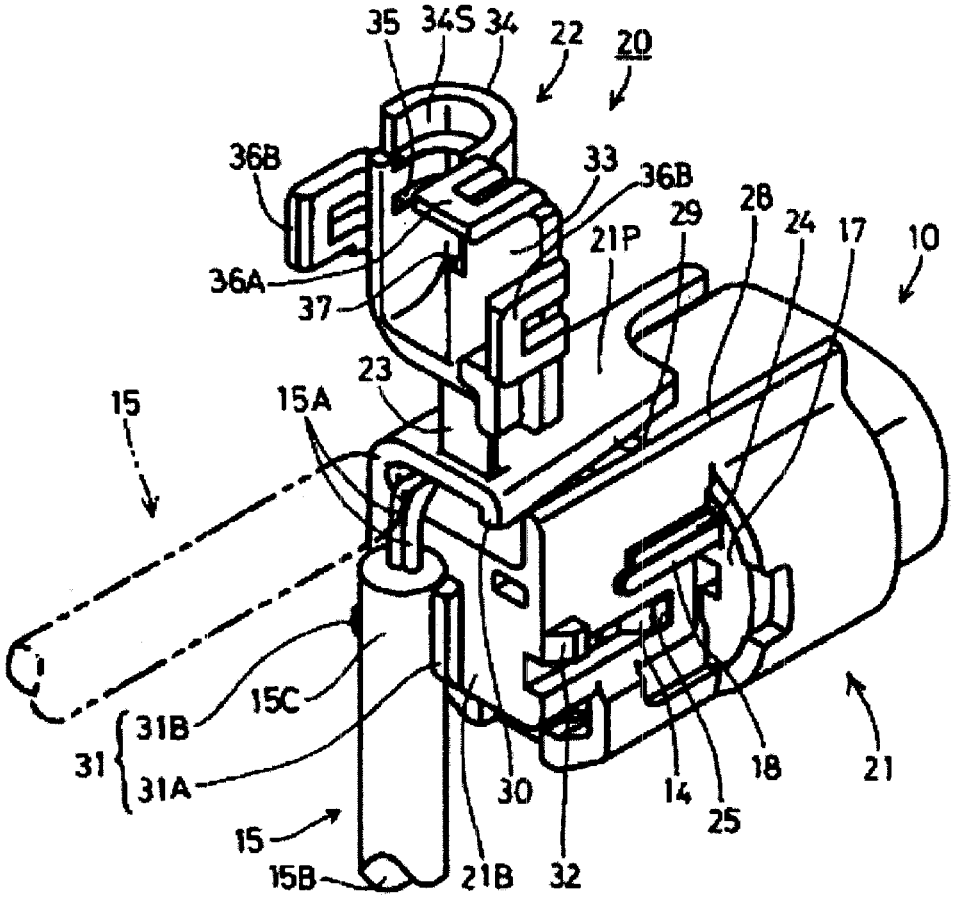
FIG. 10 is a perspective view showing the wire cable positioned relative to the housing.
Figure 11:
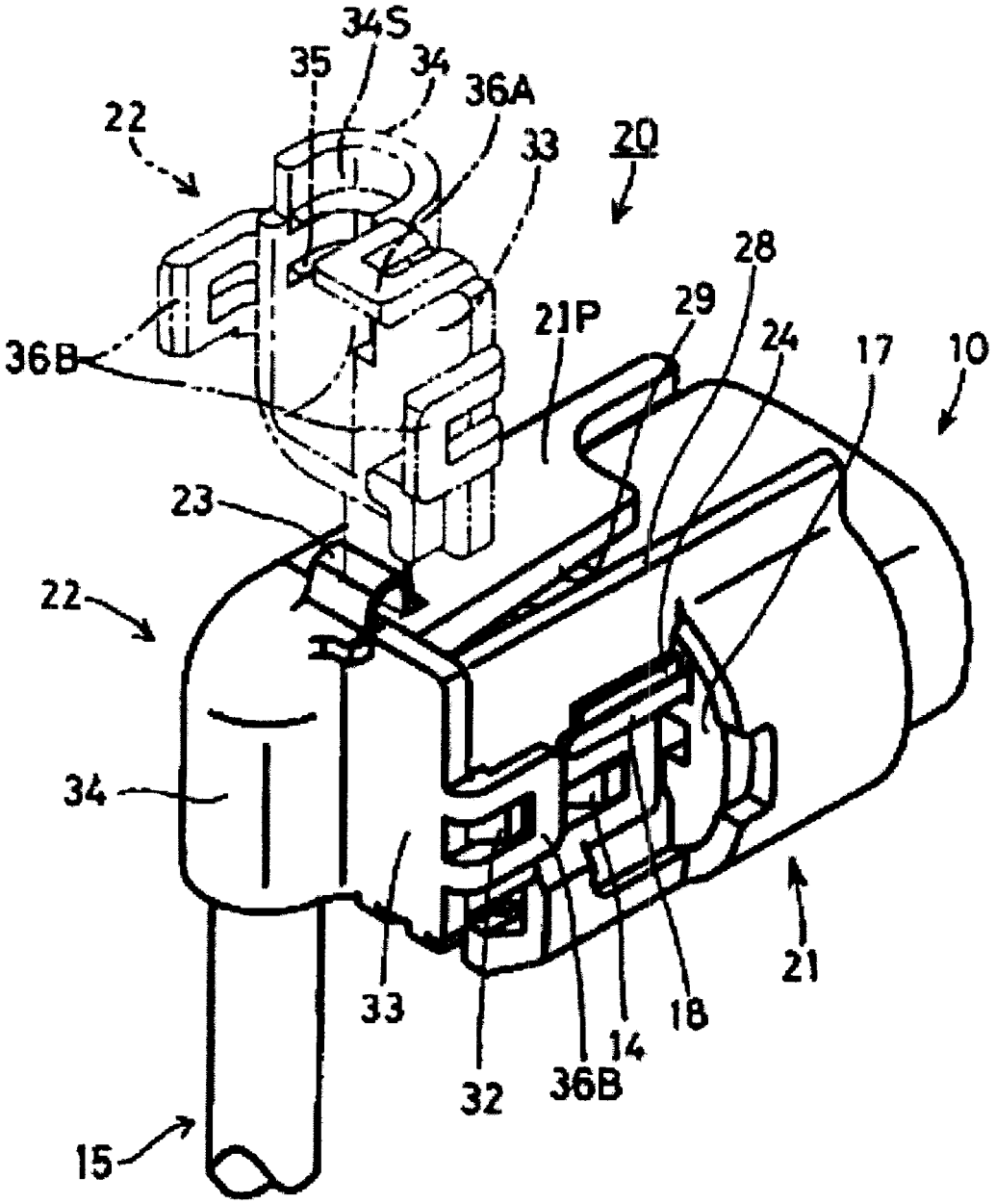
FIG. 11 is a perspective view showing the wire cable cover closed.

The fastened area 15C of wire cable 15 that was led through the space between the lower wall 21D and the preventive wall 21P, as shown with a solid line in FIG. 10, next is positioned between the ribs 31A and 31B of the back wall 21B. Under this condition, the fastened area 15C is extended along the back wall 21B of the cover body 21 in a reversed condition.

In this way, the wire cable pressing member 22 is assembled onto the back wall 21B of cover body 21. Thus, by transforming and turning over a hinge 23, the wire cable pressing member 22 is reversed with a locus of a near semi-circle when seen from the side, and with the hinge 23 taken as a fulcrum. Additionally, the wire cable supporting area 34 becomes covered over the fastened area 15C followed by fastening the fastened area 15C with the cover body 21, thereby making it difficult to cause any floating movement.

Figure 1:
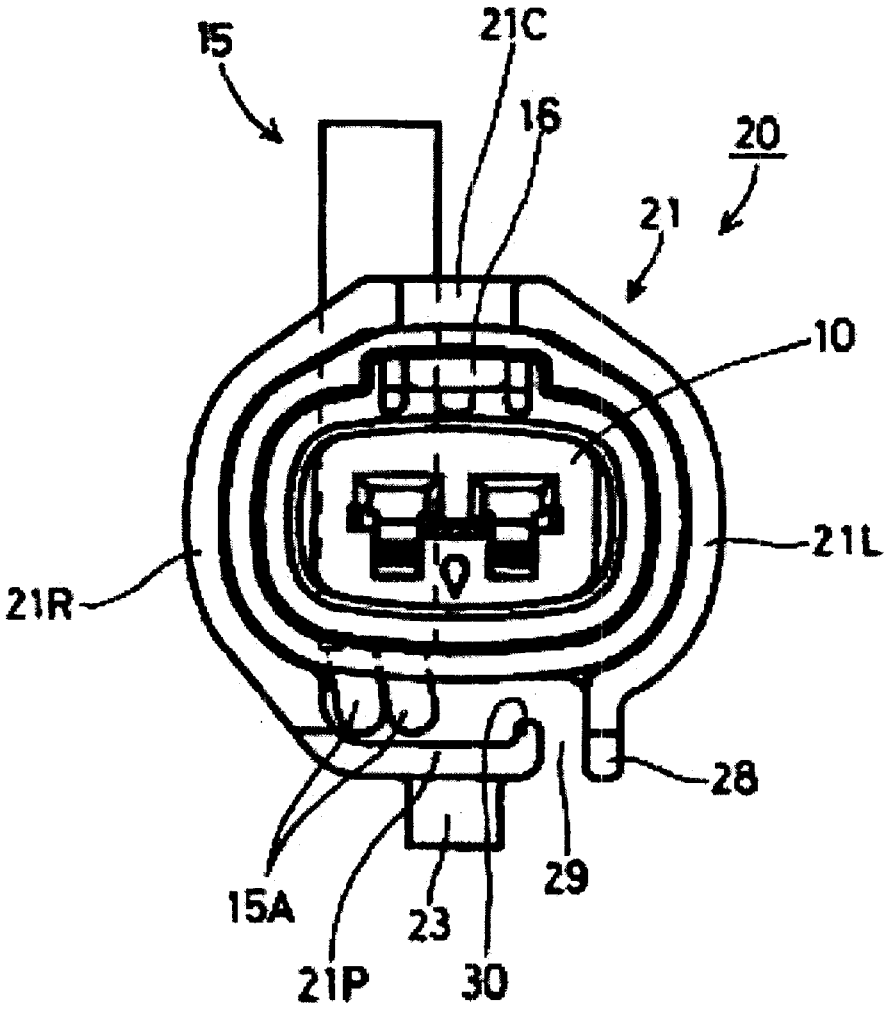
FIG. 1 is a front elevational view showing an assembled connector in accordance with the invention.
Figure 2:
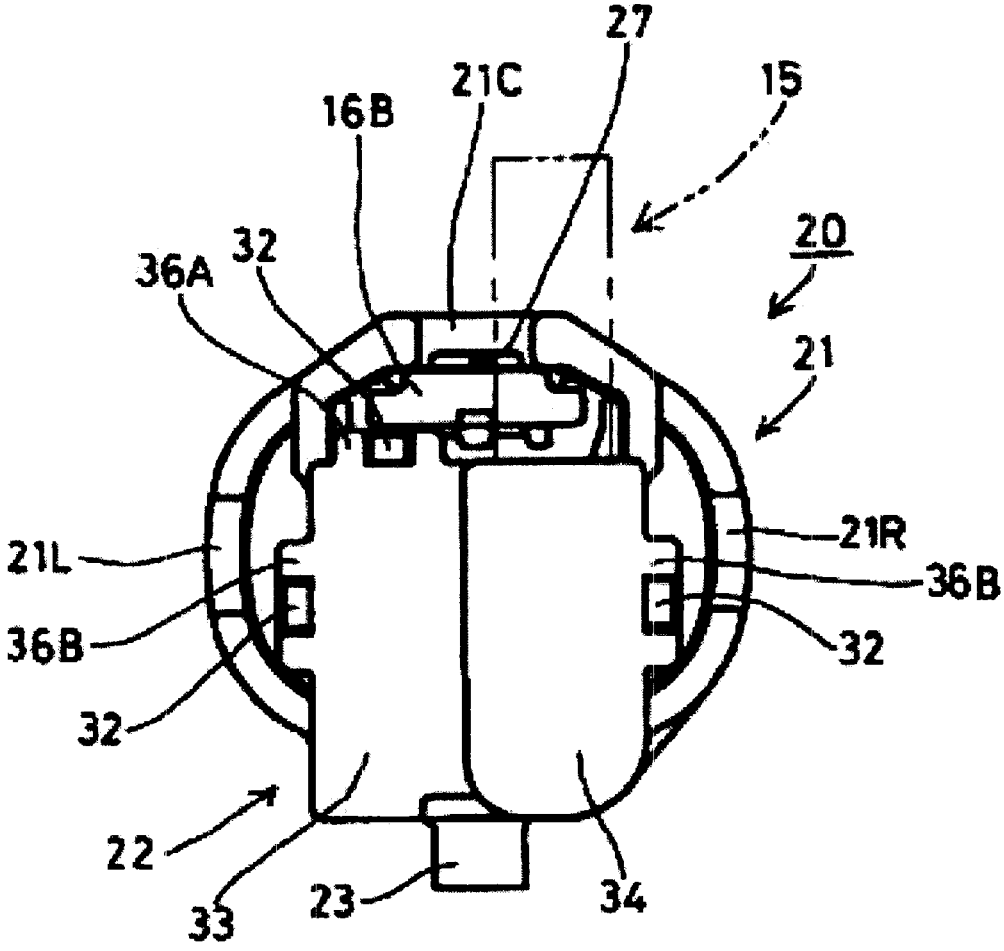
FIG. 2 is a rear elevation view of the connector shown in FIG. 1.
Figure 3:
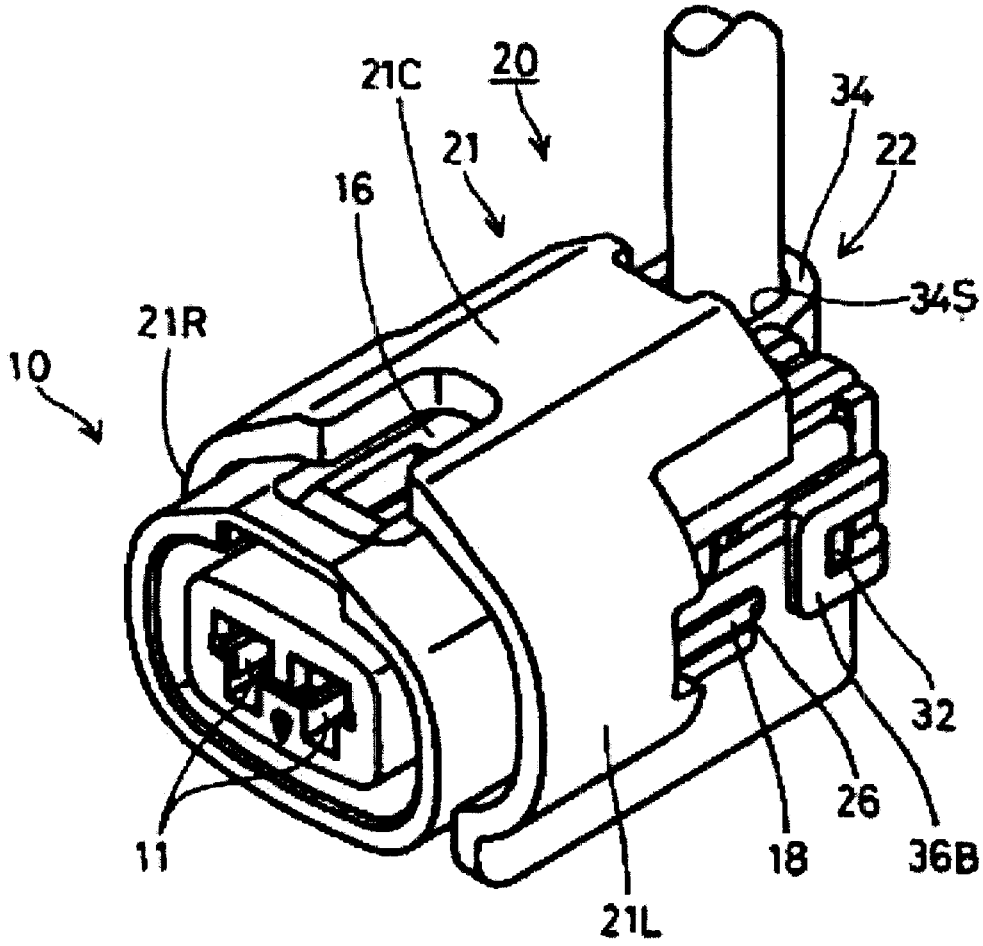
FIG. 3 is a perspective view of the connector.

The fastened area 15C of the fastened wire cable 15 has a disposition deviated to the right side from the central position in a widthwise direction, as seen from the back in FIG. 2. Therefore, the right end area of jig insertion space 27 is only slightly hidden without interruption when seen from the back, thereby providing a condition that nearly all of the parts of jig insertion space 27 allow insertion of the jig from the back. That is, to release the lock arm 16, the insertion of jig from the back into a jig insertion space 27 is not disturbed by the existence of the wire cable 15, which assures an easy and positive lock releasing operation.

The fastening position of wire cable 15 by a wire cable cover 20 is offset to the right side in a widthwise direction to the position facing the lock releasing operation area 16D on the back end face 10B of housing 10. As a result, the wire cable 15 is not disturbed when operating the lock releasing operation area 16B, and therefore lock-releasing operation can be achieved without any trouble.

The wire cable cover 20 is composed of the cover body 21 to be interfitted with the housing 10, and the wire cable pressing member 22 that fastens the wire cable 15 to the cover body 21. This assembly permits the fastened area 15C of the wire cable 15 to be assembled into the housing 10 by, first assembling the cover body 21 alone to the housing 10, then assembling the wire cable pressing member 22 onto the cover body 21 to fasten the wire cable 15 onto the cover body 21. Assembling onto the housing 10 and fastening of wire cable 15 can be treated as individual process steps, and individual process step can be simple with better workability.

Before assembling the wire cable pressing member 22 onto the cover body 21, the fastened area 15C of wire cable 15 can be positioned at the cover body 21 by using the ribs 31A and 31B. Therefore, assembling work of the wire cable pressing member 22 is made simple.

The wire cable 15 was made to have a relative displacement to a condition in which the wire cable pressing member 22 can move along a predetermined locus for the cover body 21 by way of this hinge 23 and then fastens the fastened area 15C of wire cable 15. As a result, the assembling position of the wire cable pressing member 22 for the cover body 21 is not problematic, and the fastening position of wire cable 15 can be positively offset from the lock releasing operation area 16B.

The wire cable supporting area 34 of the wire cable pressing member 22 is disposed in a position deviated to right side in a widthwise direction, while an engaging area 36A for engaging the wire cable pressing member 22 with the cover body 21 is formed in a position deviated to a left side, and hence in a position contrary to the position of wire cable supporting area 34.

This means that the engaging area 36A is disposed by effectively utilizing the dead space resulted from the displaced disposition of the wire cable supporting area 34. Therefore the wire cable pressing member 22 has no waste of space.

An inserting groove of cover body 21 is formed on the left edge. However, the wire cable 15 is fastened on the right side of the cover body 21, and hence on an opposite side to the inserting groove 29. Therefore, even if there is a loosening of the wire cable 15, there is no danger of the thin wire cable 15A running out of the inserting groove 29 after insertion into the clearance between the lower wall 21D and the preventive wall 21P.

In addition, the wire cable 15 is led through the housing 10 in a condition completely covered inside the wire cable cover 20. Consequently, the wire cable 15 is protected from any interference from foreign objects from outside, such as minute flying stone, high pressure cleaning water, etc.

The scope of technology of the present invention is not restricted to the embodiment described in the aforementioned description and drawing, for instance, the following embodiment is included in the scope of technology of the present invention. Furthermore, embodiments other than the description described below, various changes and modifications may be made therein without departing from the gist of the invention or from the scope.

In the aforementioned embodiment, the wire cable was fastened to comply with the back end face of the housing and a lock releasing operation area was on the back end face, but according to the present invention, the wire cable may be fastened to any of the upper face, side face, or lower face of housing, and the lock releasing operation area may be on the same faces.

In the aforementioned embodiment, the lock releasing operation used a jig for a lock releasing operation area, but according to the present invention, it may be possible to operate the lock releasing operation area by fingers.

In the aforementioned embodiment, the lock releasing operation area was disposed on the center in a widthwise direction and the fastening position of the wire cable by the wire cable cover was disposed on a position displaced from the center to a widthwise direction. However, the lock releasing operation area may be at a position displaced from the center in a widthwise direction. In this case, the fastening position of wire cable may be the center in a widthwise direction, and a position displaced to an opposite side to the lock releasing operation area from the center in a width wise direction may also be possible.

In the aforementioned embodiment, the wire cable pressing member was allowed to displace through a hinge to the cover body. However, according to the present invention, the wire cable pressing member and the cover body may not be in a relatively displaceable manner, and the wire cable may be fastened at the same time of assembling the wire cable cover onto the housing.

In the aforementioned embodiment, a positioning rib was formed on the cover body, but according to the present invention the wire cable pressing member may be assembled on the cover body in a condition in which the wire cable is temporarily supported by the wire cable pressing member without providing the positioning rib.

In the aforementioned embodiment, description was made for the case in which cavities inside the housing were laid out in two spaces on right and left sides, but the present invention may be applicable to more than three cavities therein.

What is claimed is:

1. A connector; comprising, a housing having at least one cavity extending therethrough;

a metal terminal inserted into the cavity of the housing;

a wire cable connected with the metal terminal and extending to a location outside the housing;

a wire cable cover mounted on the housing and fastening a first longitudinal section of the wire cable against the housing at a location substantially aligned with the cavity;

a lock arm formed on the housing at a position substantially aligned with both the cavity and the first longitudinal section of the wire cable for selectively locking the housing with a counterpart housing in an interfitting condition;

a lock releasing operation area on the housing at a location substantially aligned with the lock arm, the cavity and the first longitudinal section of the wire cable for releasing the lock arm; and an electrical wire cable supporting area provided in the wire cable cover for supporting portions of the wire cable spaced from the first longitudinal section in a position offset from the lock releasing operation area on the housing whereby said portions of the wire cable spaced from the first longitudinal section avoid interference with the lock releasing operation area.

2. A connector as set forth in claim 1, wherein the wire cable cover comprises a cover body interfitting with the housing, and a wire cable pressing member configured for urging a lead through area of the wire cable against the cover body in such a condition that the lead through area of said wire cable is fastened.

3. A connector as set forth in claim 2, wherein, a positioning area is formed in the cover body for releasably engaging the lead through area of the wire cable, the wire cable pressing member being separable from the positioning area of the cover body.

4. A connector as set forth in claim 2, wherein, the wire cable pressing member and the cover body are integrally connected through a hinge, the wire cable pressing member is displaceable such that the lead through area of the wire cable is fastened to the cover body by following a locus defined by the hinge.

5. A connector as set forth in claim 2, wherein, the wire cable supporting area is disposed to one end side of a width direction in the wire cable pressing member, and an engaging area for engaging the wire cable pressing member in the cover body is formed in the wire cable pressing area at a position shifted to an opposite side of the wire cable supporting area.

6. A connector comprising:

a housing having opposite front and rear ends and at least one cavity extending between the ends, the housing further having opposite first and second lateral sides;

a wire cable cover comprising a cover body mounted to the rear end of the housing, and a wire cable pressing member connected to the cover body, the wire cable cover defining a first wire cable engaging passage between the cover body and the housing and a second wire cable engaging passage between the cover body and the wire cable pressing member, at least a portion of the second wire cable engaging passage being in a position closer to the first side than to the second side of the housing.

7. The connector of claim 6, wherein the wire cable cover is of unitary construction.

8. The connector of claim 7, wherein the wire cable pressing member is hinged to the cover body.

9. The connector of claim 6, wherein the cover body includes a retaining portion for retaining the wire cable in the position closer to the first side of the housing.

10. The connector of claim 6, wherein the housing further comprises a lock arm for locking said housing with a mating housing, the lock arm being accessible at a location at the rear end of the housing and between the opposite first and second sides of the housing, the lock arm being positioned symmetrically relative to the lateral sides.

11. A connector comprising:

a housing having opposite front and rear ends and at least one cavity extending between the ends, the housing further having opposite first and second lateral sides;

a terminal mounted in the cavity;

a wire cable connected to the terminal and extending rearwardly from the housing;

a wire, cable cover comprising a cover body mounted to the rear end of the housing, and a wire cable pressing member mounted to the cover body, the wire cable cover body being configured for engaging a first longitudinal portion of the wire cable between the cover body and the housing and for engaging a second longitudinal portion of the wire cable between the cover body and the wire cable pressing member, the wire cable pressing member being configured for engaging the second longitudinal portion wire cable in a position closer to the first side than to the second side of the housing.

12. A connector as set forth in claim 5, wherein the wire cable supporting area of the cable pressing member and opposite portions of the cover body define a generally tubular passage for the receiving the wire cable, the wire cable pressing area being substantially flat and adjacent the cover body for preventing insertion of the wire cable, whereby the wire cable is maintained in the tubular passage and offset from the lock releasing operation area.

13. A connector as set forth in claim 1, wherein the housing has opposite front and rear ends, the wire cable extending from the rear end of the housing, the wire cable cover defining a first area extending from the rear end of the housing to an intermediate location between the front and rear ends of the housing for holding a longitudinal section of the wire cable between the housing and the wire cable cover, a second section extending from the intermediate location to a location rearward of the housing for holding a second longitudinal section of the wire cable within the wire cable cover and third section rearward of the housing for holding a third longitudinal section of the wire cable aligned substantially orthogonal to the cavities and at the position offset from the lock releasing operation area on the housing.

14. The connector of claim 11, wherein the wire cable cover is of unitary construction.

15. The connector of claim 14, wherein the wire cable pressing member is hinged to the cover body.

16. The connector of claim 11, wherein the cover body includes a retaining portion for retaining the wire cable in the position closer to the first side of the housing.

17. The connector of claim 11, wherein the housing further comprises a lock arm for locking said housing with a mating housing, the lock arm being accessible at a location at the rear end of the housing and centrally between the opposite first and second lateral sides of the housing, the lock arm being positioned offset from the portions of the wire cable pressing member configured for engaging the second longitudinal portion of the wire in a position closer to the first side then to the second side of the housing.

* * * * *